US009625119B2

(12) United States Patent
Wang et al.

(10) Patent No.: US 9,625,119 B2
(45) Date of Patent: Apr. 18, 2017

(54) NON-UNIFORM LENS ARRAY FOR ILLUMINATION PROFILE MODIFICATION

(71) Applicant: Excelitas Canada, Inc., Vaudreuil-Dorion (CA)

(72) Inventors: Yong Wang, Markham (CA); Erik Sorensen, Mississauga (CA); Stewart Clark, Toronto (CA)

(73) Assignee: Excelitas Canada, Inc., Vaudreuil-Dorion (CA)

( * ) Notice: Subject to any disclaimer, the term of this patent is extended or adjusted under 35 U.S.C. 154(b) by 147 days.

(21) Appl. No.: 14/448,193

(22) Filed: Jul. 31, 2014

(65) Prior Publication Data

US 2016/0033089 A1 Feb. 4, 2016

(51) Int. Cl.

| | |
|---|---|
| ***F21K 99/00*** | (2016.01) |
| ***F21V 7/00*** | (2006.01) |
| *B41J 11/00* | (2006.01) |
| *F21V 7/04* | (2006.01) |
| *F21V 7/06* | (2006.01) |
| *F21V 7/08* | (2006.01) |
| *F21Y 101/00* | (2016.01) |
| *F21Y 105/12* | (2016.01) |
| *F21Y 105/10* | (2016.01) |

(52) U.S. Cl.

CPC ..... *F21V 7/005* (2013.01); *B41J 11/002* (2013.01); *F21V 7/04* (2013.01); *F21V 7/06* (2013.01); *F21V 7/08* (2013.01); *F21Y 2101/00* (2013.01); *F21Y 2105/10* (2016.08); *F21Y 2105/12* (2016.08)

(58) Field of Classification Search

CPC ..... F21Y 2105/003; F21Y 2113/02
USPC ..... 362/244
See application file for complete search history.

(56) References Cited

U.S. PATENT DOCUMENTS

| | | | | |
|---|---|---|---|---|
| 8,581,269 | B2 | 11/2013 | Kuk et al. | |
| 9,057,498 | B2 * | 6/2015 | Nall | F21V 5/04 |
| 2007/0091602 | A1 * | 4/2007 | van Voorst Vader | G03B 15/05 362/244 |
| 2012/0001208 | A1 * | 1/2012 | Brick | H01L 25/0753 257/89 |
| 2012/0161116 | A1 * | 6/2012 | Aoyama | H01L 25/048 257/40 |
| 2013/0187548 | A1 | 7/2013 | Childers | |
| 2013/0201673 | A1 * | 8/2013 | Chien | F21V 21/088 362/217.13 |
| 2014/0367709 | A1 * | 12/2014 | Bierhuizen | H01L 25/0753 257/88 |

(Continued)

*Primary Examiner* — Ismael Negron
*Assistant Examiner* — Eric T Eide
(74) *Attorney, Agent, or Firm* — Peter A. Nieves; Sheehan Phinney Bass & Green PA

(57) ABSTRACT

Embodiments of a light source include a substrate having a first end and a second end opposite the first end. A plurality of solid state light emitting diodes (LEDs) form an array, with the plurality of LEDs mounted on the substrate in a row between the first end and the second end. The plurality of LEDs further have a first edge LED and a second edge LED having a first encapsulation lens height relative to the substrate. At least one interior LED having a second encapsulation lens height less than the first encapsulation lens height is disposed between the first edge LED and the second edge LED. The spacing between the plurality of LEDs is substantially uniform.

7 Claims, 12 Drawing Sheets

(56) References Cited

U.S. PATENT DOCUMENTS

2014/0374780 A1* 12/2014 Schaefer ..... H01L 33/507
257/88

* cited by examiner

NON-UNIFORM LENS ARRAY FOR ILLUMINATION PROFILE MODIFICATION

FIELD OF THE INVENTION

The present invention relates to illumination, and more particularly, is related to solid state light emitting devices.

BACKGROUND OF THE INVENTION

In recent years, solid state light emitting devices such as light emitting diodes (LEDs) have been developed as a type of energy efficient sources for industrial processes, for example, photoreactive or photo-initiated processes, such as photo-curing of inks, adhesives and other coatings. Traditional arc lamps, which are conventionally used as ultraviolet (UV) light sources for industrial processes, contain mercury. Thus solid-state light sources may be preferred to arc lamps for environmental reasons, as well as for having a longer lifetime. UV LEDs have attracted a lot of attention because they generate much less heat and consume much less power than arc lamps, while providing the same light output. Many inks, adhesives and other curable coatings have free radical based or cationic formulations which may be photo-cured by exposure to UV light. Applications for UV LEDs include curing of large area coatings, adhesive curing, as well as print processes such as inkjet printing. Curing uniformity is critical for many large area photo-induced curing processes.

In many UV photo-curing applications large areas must be illuminated with a high density of UV radiation. UV LED sources commonly used in the inkjet industry have lines or arrays of a large number of LEDs packed closely to each other so that jetted ink layers receive continuous irradiation. A typical LED based light source includes an array chip/die having many LEDs in order to achieve the energy density required to initiate the photochemical reaction. To efficiently build an LED array system with different length or area, such as a three inch, six inch or twelve inch length, usually a short LED array is built as a basic element, for example, one inch long to three inches long.

A single LED chip/die generally will not meet the application requirements for power and irradiance so it is common to combine multiple LED dies on a substrate, within manufacturing limitations, to form a multi-chip LED module. The large LED array system is built using multiple basic elements. These basic element arrays are fabricated on a substrate, which has the individual die bonded or soldered on printed circuit boards (PCB) in serial, parallel or a combination of serial and parallel. Large LED array light sources of a desired area can then be formed by combining many multi-chip LED array modules.

The traces of a PCB may be configured for high driving current, spacing for wire bonding, and/or edge clearance of high current PCB to meet the electrical PCB design standard, all of which require a minimum edge around the PCB. In the abutting region where two multi-chip LED array modules are joined together, a high density chip-to-chip spacing cannot be maintained for chips with uniform LEDs having uniform spacing. When these LED arrays are abutted, there is a gap or spacing between adjacent groups of LED arrays, which may be, for example, 2 to 4 mm (see FIG. 2). This means that there is uniform illumination intensity along the length of each module, but there is a dip in intensity in the region where each module abuts, which tends to cause a banding effect in the substrate being cured. This results in a decrease in the irradiance over the abutting region, thus the overall uniformity of the illumination area is compromised.

It is well known in the art that light extraction from an LED die can be improved by encapsulating the LED in a hemispherical dome or plane-convex lens comprising optical materials with an index of refraction greater than one. This dome or lens structure can also change the light directivity from the LED die.

U.S. Pat. No. 8,581,269 provides a non-evenly spaced LED array light source having a plurality of LED modules, each module comprising a module substrate carrying a plurality of LED light source elements arranged in an array, each module having at least one edge portion of the substrate abutting that of another module, and the spacing of LED light source elements of the array in each module being arranged to provide a higher density of die at edges of the array where edge portions of two modules abut. Thus, arrangements of LED die in each LED array provides for a substantially uniform irradiance where two modules abut, and reduce or overcome edge effects. U.S. Patent Publication 2013/0187548 A1 proposes a similar concept as U.S. Pat. No. 8,581,269.

LED encapsulation is widely used to increase light extraction from LEDs and to provide better light directivity, and to further provide better coupling from an LED die to curing targets. Sometimes, multiple layers with different refractive index and hardness are used to extract more light from LED Dies and to protect the LED wire bonding, as per, for example, U.S. Pat. No. 7,798,678 B2 and WO 05043598 A2. To achieve greater extraction efficiency, certain encapsulation dimensions and spacing between LEDs may be desirable for array encapsulation. For example, the diameter of an encapsulation lens should be greater than twice the LED dimensions. The spacing between LEDs should be greater than a diameter of the encapsulation. Because of these reasons, the above described non-evenly spaced LED array light source intended to improve the uniformity of illumination is not efficient for an encapsulated LED array.

In addition, for applications using a single LED array, the illumination levels may roll off rapidly in the area above the edges of the array (see FIG. 1D). Therefore, there is a need in the industry to overcome some or all of the abovementioned shortcomings.

SUMMARY OF THE INVENTION

Embodiments of the present invention provide a non-uniform lens array for illumination profile modification. Briefly described, the present invention is directed to a light source with a substrate having a first end and a second end opposite the first end. A plurality of solid state light emitting diodes (LEDs) form an array, with the plurality of LEDs mounted on the substrate in a row between the first end and the second end. The plurality of LEDs further have a first edge LED and a second edge LED having a first encapsulation lens height relative to the substrate. At least one interior LED having a second encapsulation lens height less than the first encapsulation lens height is disposed between the first edge LED and the second edge LED. The spacing between the plurality of LEDs is substantially uniform.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1A:
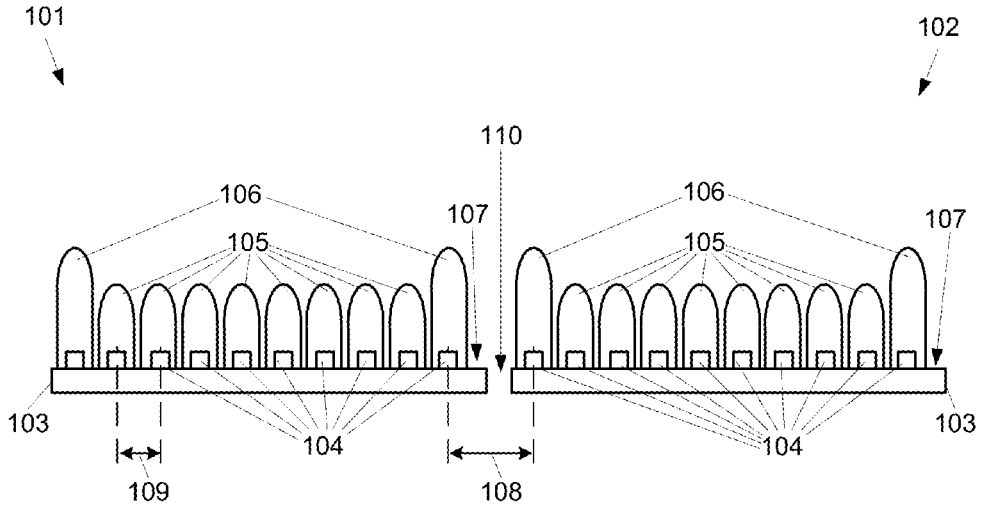
FIG. 1A is a schematic diagram of an exemplary first embodiment of an LED array arrangement from a side view.

The following definitions are useful for interpreting terms applied to features of the embodiments disclosed herein, and are meant only to define elements within the disclosure.

As used within this disclosure, "substantially" means "very nearly," for example, "substantially uniform" means uniform within normal manufacturing tolerances as would be expected by persons having ordinary skill in the art.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "array" should be understood to refer to a regular arrangement of LEDs, for example, but not limited to a rectangular m×n array having m rows of n substantially linear columns of LEDs, such that m is at least 1 and n is at least 3. Adjacent rows of LED columns are generally parallel, such that the LEDs in adjacent rows may be aligned, or may be offset. Unless otherwise stated, the spacing between LEDs in a row are generally uniformly spaced.

The term "encapsulating lens height" refers to the distance from the LED surface to the first refracting surface of the encapsulation lens.

Reference will now be made in detail to embodiments of the present invention, examples of which are illustrated in the accompanying drawings. Wherever possible, the same reference numbers are used in the drawings and the description to refer to the same or like parts.

Embodiments of the present invention provide improved uniformity of illumination over an abutting area between adjacent LED arrays with mixed encapsulation lenses. As discussed above, it is well known in the art that light extraction from an LED die can be improved by encapsulating the LED in a hemispherical dome comprising optical materials with an index of refraction greater than 1. This dome or lens structure can also change the light directivity from the LED die. Embodiments of the present invention leverage these properties for a novel LED encapsulation structure that improves the uniformity of the irradiance profile in the abutting region between chips when using multiple LED array modules to illuminate an area.

Figure 2:
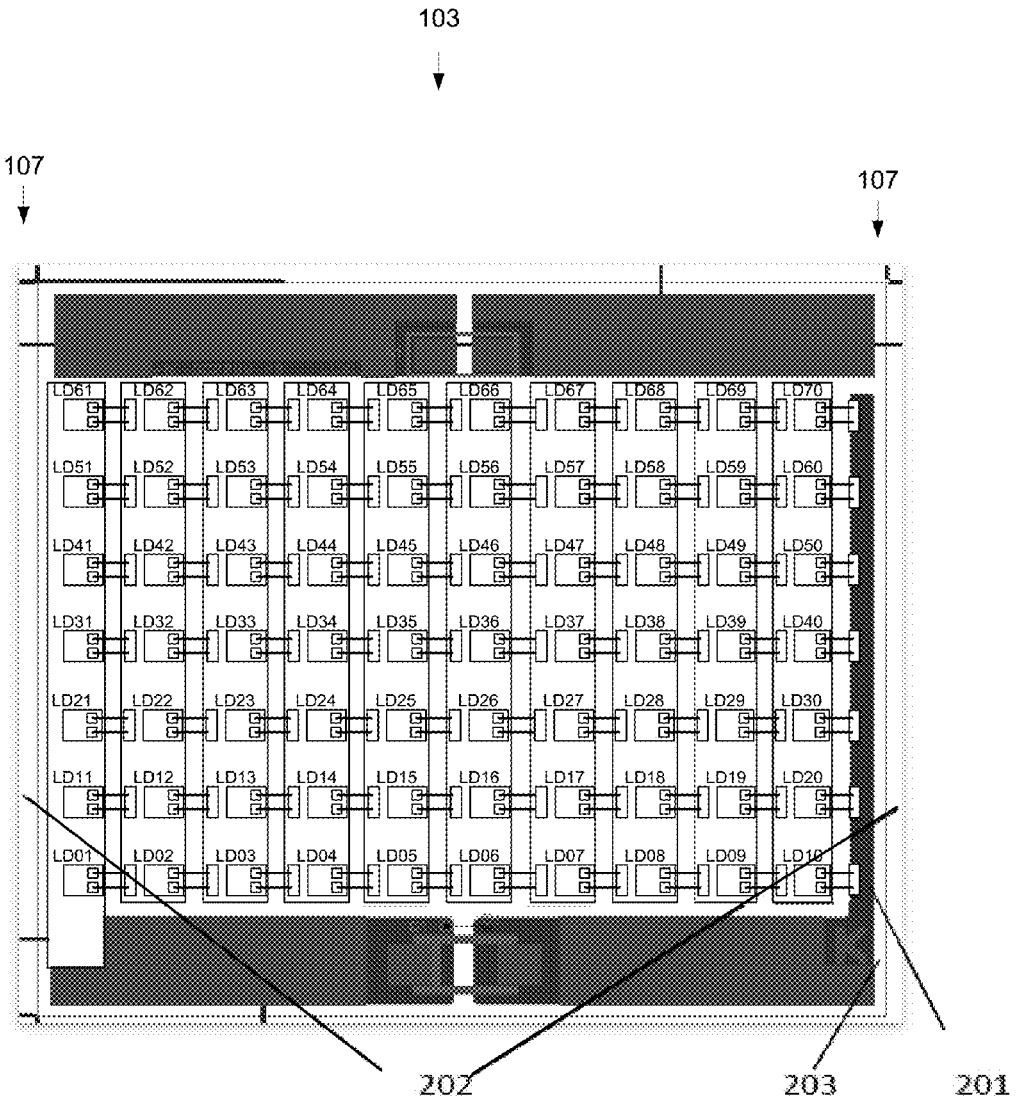
FIG. 2 is a schematic diagram of a printed circuit board for an LED array according to the first embodiment of FIG. 1A.

FIG. 1A shows first exemplary embodiment of an LED system having a first LED array module 101 and a second LED array module 102. Each LED array 101, 102 includes at least one row of LED dies 104 bonded, for example, soldered, to a substrate 103. FIG. 1A shows a side view of the arrays 101, 102, where a single row of LEDs may be seen. The arrays 101, 102 may have one, two, three, or more rows of LEDs. The LED dies 104 may be arranged in a substantially straight line, with a substantially uniform spacing 109 between each adjacent LED per array module 101, 102. Each LED 104 includes an encapsulation lens 105 or 106, where the edge encapsulation lenses 106 may have a greater height than the interior encapsulation lenses 105. Each LED array module 101, 102 has extra spacing 107 at edge of the substrate 103, for example, to accommodate the electrical trace for powering the modules 101, 102. As shown in FIG. 2, this extra spacing 107 may include, for example, a wire bonding trace 201 for high driving current and wire bonding and a PCB boundary tolerance region 202, 203 providing clearance for a high current electrical trace, wire bonding pad and a PCB boundary tolerance region.

Returning to FIG. 1A, in addition, a gap 110 may be present between adjacent LED modules 101, 102. The combination of the extra spacing 107 and the gap 110 may contribute to the additional distance between edge LEDs 106 in comparison with the LED gap 109 between two adjacent LEDs within a single LED array module 101, 102. The abutting region 108 between substrates 103 of adjacent modules 101, 102 including the gap 110 and the extra spacing 107 results in an abutting region having larger spacing 108 between the edge LEDs 106 of module 101 and the edge LEDs of module 102 than the otherwise uniform spacing 109 between adjacent LEDs on a single module 101, 102.

Under the first embodiment, the LEDs 104 in the two end regions of the multi-chip LED modules 101, 102 have a different encapsulation structure 106 than the encapsulation structure 105 of the intermediate LEDs 104 in the interior of the array modules 101, 102. The encapsulation structures 105, 106 are configured to increase the light extraction across the entire module 101, 102 while also changing the directivity of light in the abutting region 108, thus improving the optical uniformity between the two array modules 101, 102.

Figure 1B:
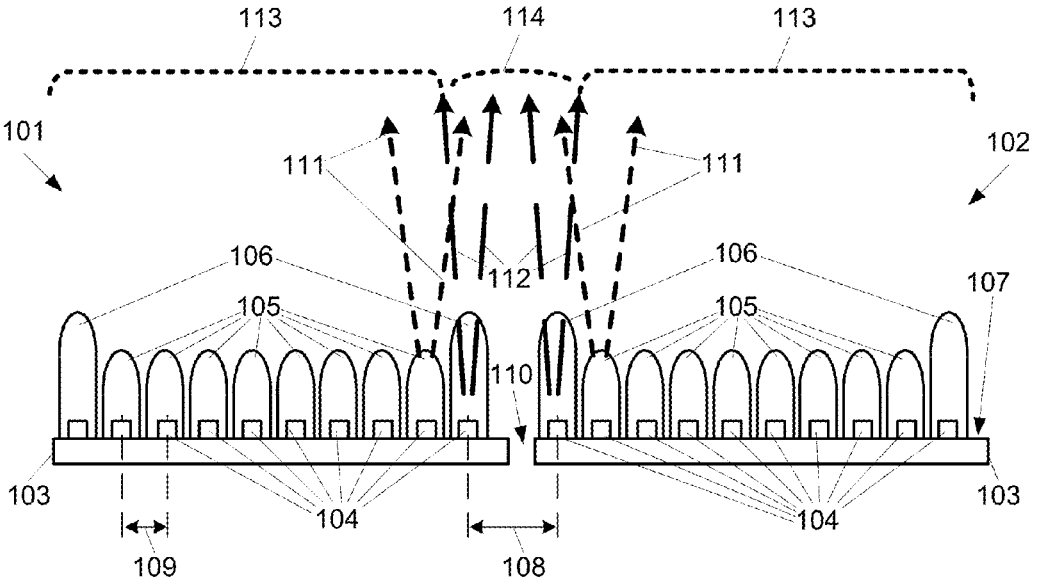
FIG. 1B is a schematic diagram illustrating the illumination intensity of the first embodiment of FIG. 1A.
Figure 1C:
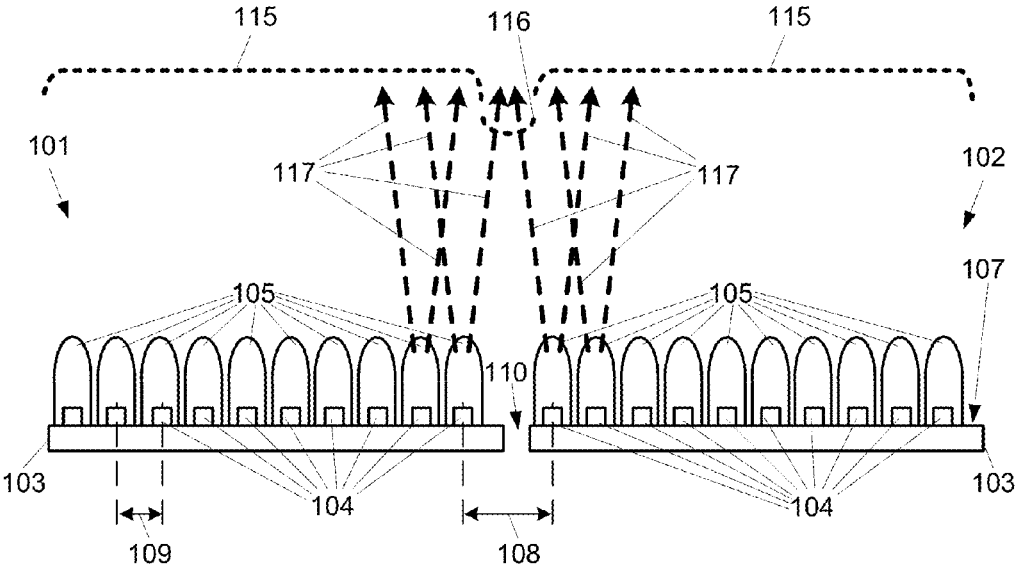
FIG. 1C PRIOR ART
FIG. 1C is a schematic diagram illustrating the illumination intensity of a prior art LED array arrangement.

FIG. 1B illustrates the illumination power of adjacent array modules 101, 102 under the first embodiment, while FIG. 1C illustrates the illumination power of adjacent modules 101, 102 in a prior art system. In FIG. 1B, dash lines 113 indicate an integrated power level in a non-abutting region above the modules 101, 102 and the dashed line 114 indicates the integrated power above the abutting area 108 between the modules 101, 102 with the modified lens/encapsulation structure 106. In FIG. 1C dashed lines indicates an integrated power level above non-abutting regions 115 over the modules 101, 102, and the dashed line 116 indicates the integrated power above the abutting region 108 between the modules 101, 102.

In FIG. 1B, the output beams 112 from the outer raised edge encapsulation lenses 106 have narrower directivity than output beams 111 from the interior encapsulation lenses 105. The narrower directivity of the output beams 112 may be due to several factors regarding the dimensions of the edge encapsulation lenses 106, including, for example, the height of the edge encapsulation lenses 106, the diameter (or width) of the edge encapsulation lenses 106, and the shape of the edge encapsulation lenses 106. The edge encapsulation lenses 106 direct more light beams 112 from the edge LEDs 104 with edge encapsulation lenses 106 above the abutting region 108. This additional illumination contribution above the abutting region 108 from edge beams 112 compensates for the power loss caused by the gap in the abutting region 108. Thus, the overall illumination uniformity above the modules 101, 102 is improved. In contrast the uniformity of the irradiance profile of the prior art arrangement with uniformly sized encapsulation structures 105 as shown in FIG. 1C is poor.

If heights of the edge encapsulation lenses 106 are the same as the heights of the interior encapsulation lenses 105, the integrated power per unit length in lateral direction (perpendicular to the LED array 101, 102) will be lower above the abutting area 108 than above the interior encapsulation lenses 105. The non-uniformity is more pronounced if the distance from the LED array 101, 102 to an illuminated target (not shown) is small, for example, in a digital print application where ink to be cured is deposited onto a substrate that is 2-4 mm from the light source. For some applications, better directivity provided by the encapsulation lenses 106 may be needed to have higher irradiance at the illuminated target (not shown), providing edge encapsulation lenses 106 are greater than the height of the interior encapsulation lenses 105 may be used. For example, the edge encapsulation lenses 106 may be a half ball higher than the interior encapsulation lenses 105. For example the edge encapsulation lenses 106 may be raised a distance greater than the radii of the hemispherical lens away from the LED surface. The decrease of the integrated power per unit length is more pronounced above the abutting area 108 because the contribution from adjacent LEDs 104 is less due to the better light directivity of edge encapsulated LEDs 106. In the first embodiment, there is at least one edge encapsulation lens 106 at each end of a row of LEDs 104 with interior encapsulation lenses 105.

Figure 1D:
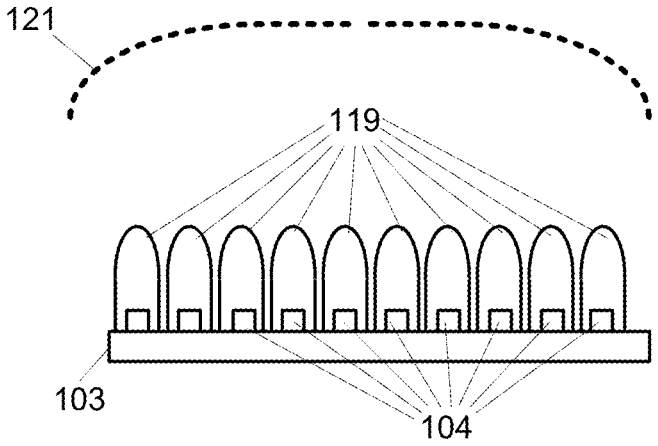
FIG. 1D (PRIOR ART)
FIG. 1D is a schematic diagram illustrating the illumination intensity of a single prior art LED array.
Figure 1E:
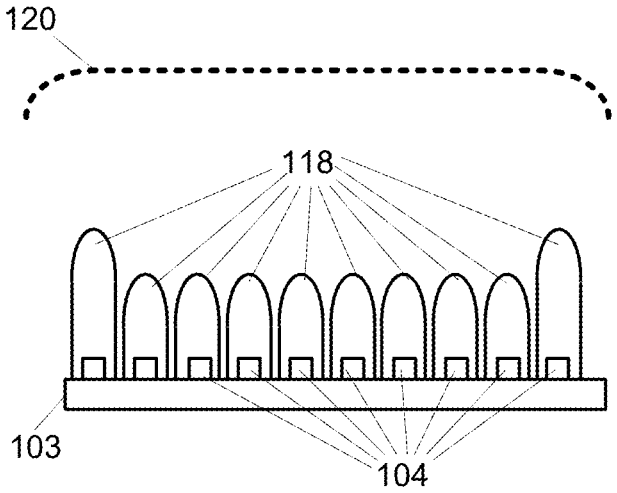
FIG. 1E is a schematic diagram illustrating the illumination intensity of a single LED array under the first embodiment.

In FIG. 1C, the dashed line 116 shows the decreased integrated power above the abutting area 108 without raised edge lenses 106 (FIG. 1B), in comparison with the power level 115 above the non-abutting portion of the arrays 101, 102. All LEDs have same encapsulation lens 105, and therefore emit the same beam 117, providing no additional contribution above the abutting area 108. The integrated power above the abutting area 108, shown by line 116 is much lower than above the abutting area 108 as shown by line 114 (FIG. 1B) under the first embodiment having raised edge lenses 106. As shown in FIG. 1E, the sharpness of the edge illumination 120 is also improved if the interior lens encapsulations are the same height, but with raised edge lens encapsulations 119, as compared with an array (shown in FIG. 1D) where the edge illumination pattern 121 over lens encapsulations having uniform height rolls off more gradually.

Figure 3:
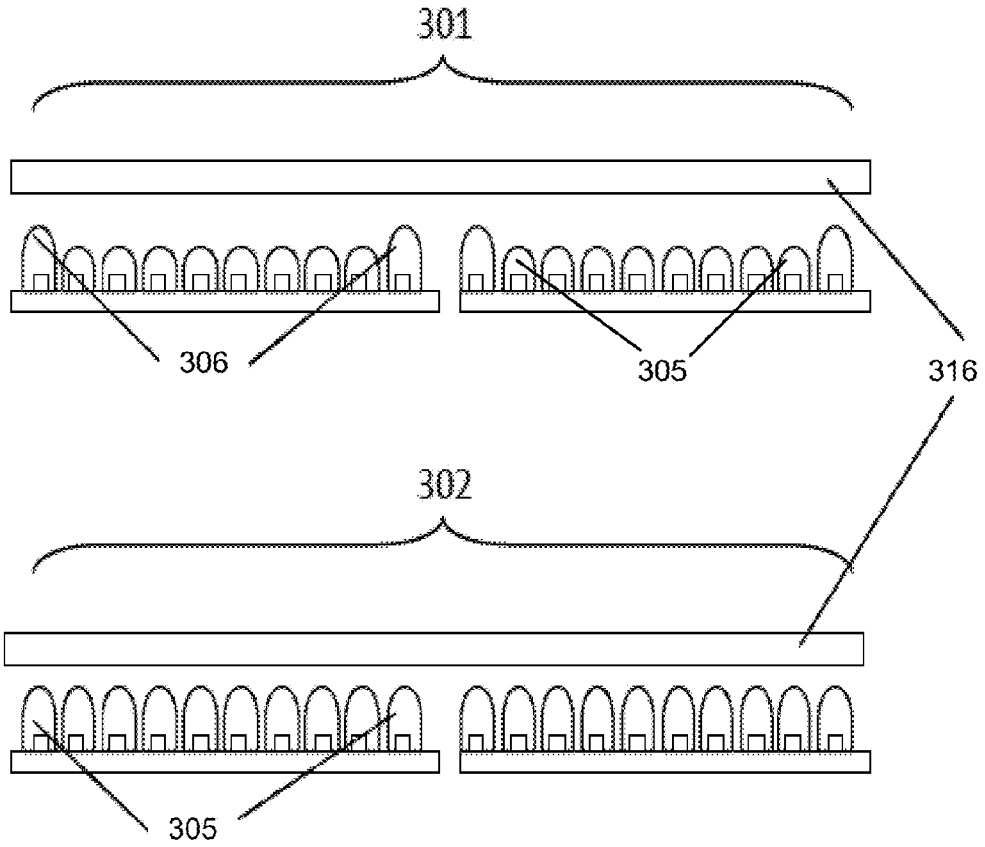
FIG. 3 is a schematic diagram illustrating two different exemplary optical configurations.

FIG. 3 shows a first optical configuration 301 and a second optical configuration 302 used in a simulation. In the second configuration, 302, all encapsulation lenses 305 have the same diameter and height. In the first optical configuration 301, the encapsulation lenses of the interior LEDs 305 are the same, but the two-end LED 306 have the same diameter but with higher raised lenses. Secondary optics 316 are positioned above the first optical configuration 301 and the second optical configuration 302. The secondary optics 316 above the first optical configuration 301 and the second optical configuration 302 are substantially the same. The secondary optics 316 may provide light shaping and or filtering capabilities, and are positioned generally parallel to the surfaces of the first optical configuration 301 and the second optical configuration 302. The height of the secondary optics 316 above the first optical configuration 301 and the second optical configuration 302 may be adjusted to provide different results.

Figure 4:
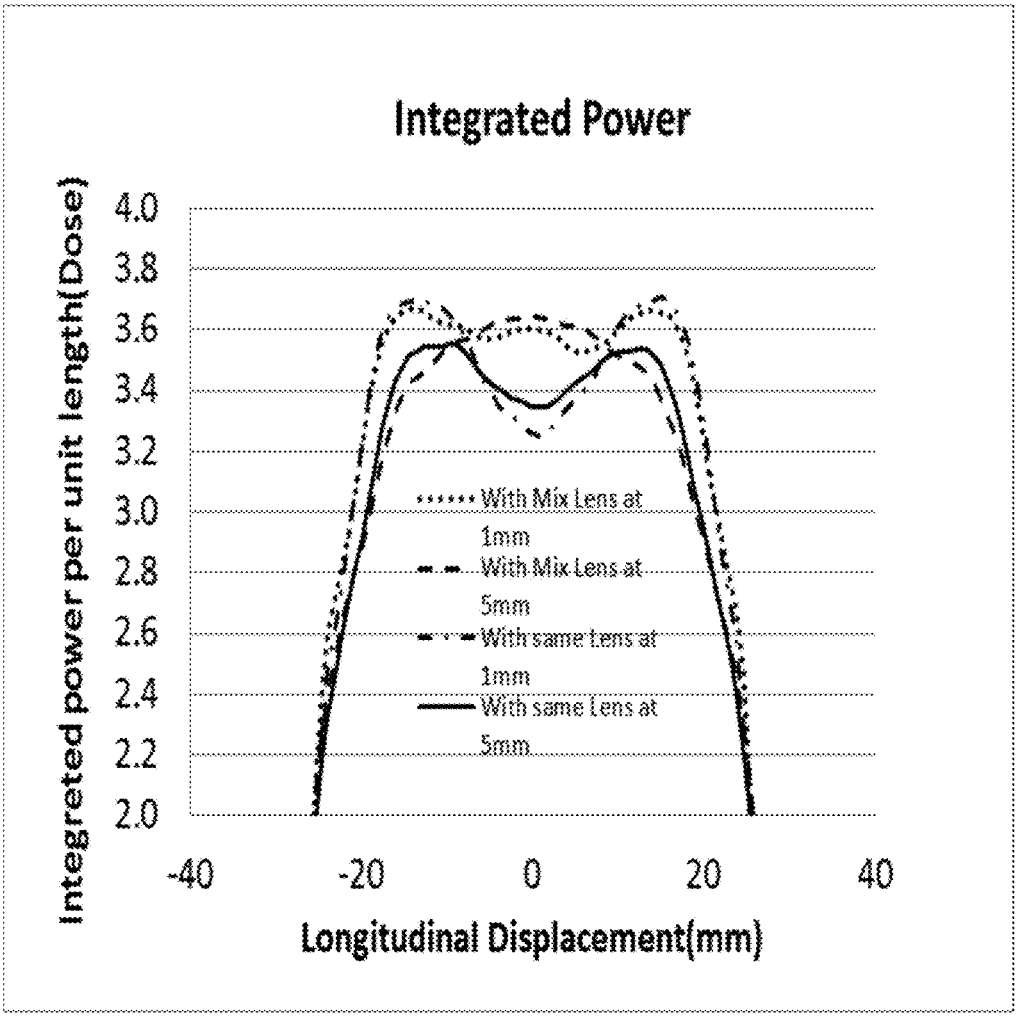
FIG. 4 is a graph showing simulation results for optical configurations shown in FIG. 3.

FIG. 4 is a graph showing the simulation results for optical configurations 301 and 302 in FIG. 3. In this simulation, the LED dimensions are 1×1 $mm^2$ for the two different optical configurations 301, 302 used. For the second optical configuration 302, all lenses 305 have the same diameter of 2.4 mm and a height of height 1.5 mm from the LED surface. In the first optical configuration 301, the interior encapsulation lenses 305 have a 2.4 mm diameter and a 1.35 mm height from LED surface, while the two end encapsulation lenses 306 have a 2.4 mm diameter and a 1.50 mm height from LED surface. For mixed lens encapsulation, the uniformities are significantly improved for both 1 mm and 5 mm cases.

Figure 5:
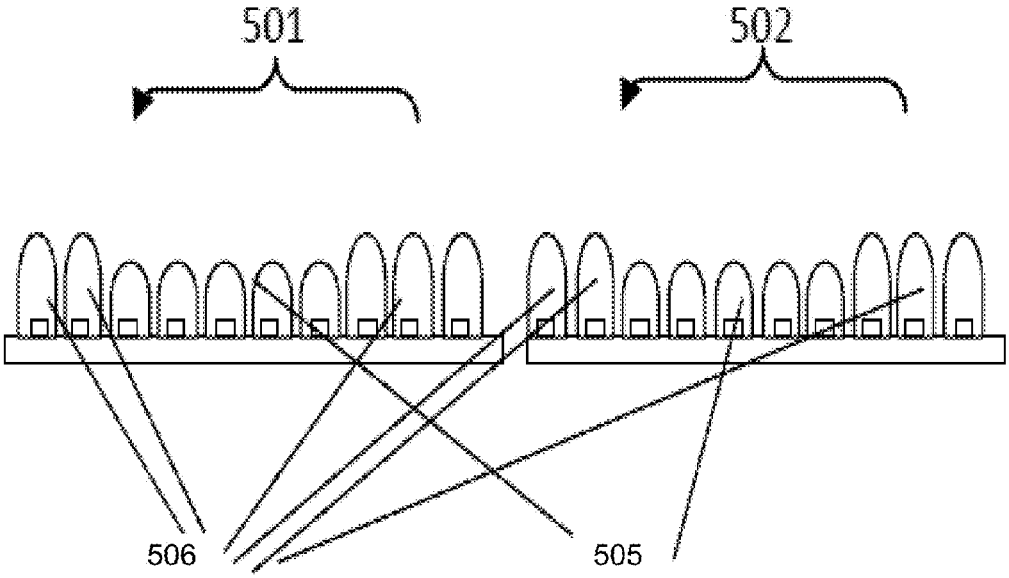
FIG. 5 is a schematic diagram illustrating a second exemplary embodiment of a mixed LED array with multiple raised lenses.

Under a second exemplary embodiment a mixed LED array 501, 502 may have multiple raised edge lenses 506, as shown in FIG. 5. FIG. 5 shows a side view of the arrays 501, 502, where a single row of LEDs may be seen. The arrays 501, 502 may have one, two, three, or more rows of LEDs. The edge lenses 506 have a different height than interior lenses 505. FIG. 5 shows LED array 501, 502 with two end lenses 506 having a greater height at a first end of each array row and three edge lenses 506 having a greater height at a second end of each array row, and multiple interior lenses 505 having a shorter height. However there may be embodiments where the first end and the second end of a row have the same number of edge lenses 506. Furthermore, either end of the row may have one, two, three, four, or more edge lenses 506. The number of lenses selected for a particular application may vary according to several factors, for example, the lens shape and working distance from the arrays 501, 502 to an object being illuminated by the arrays 501, 502.

Adjacent rows of LEDs in the arrays 501, 502 may be similarly configured in terms of the number of edge lenses 506 and interior lenses 505 and the arrangement of edge lenses 506 and interior lenses 505. Alternatively, adjacent rows of LEDs in the arrays 501, 502 may be differently configured in terms of the number of and arrangement of edge lenses 506 and interior lenses 505. For example, the arrays 501, 502 may be arranged as an m×n array of LEDs, where a row $m_p$ is similarly configured to a column $n_p$.

Figure 6:
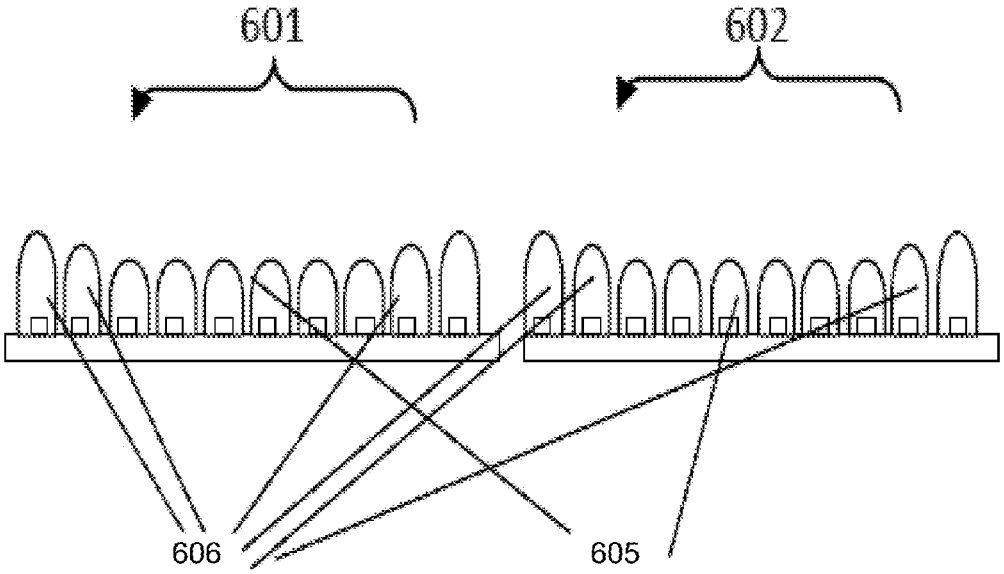
FIG. 6 is a schematic diagram illustrating an embodiment of a mixed LED array having multiple raised lenses with varied heights.
Figure 7:
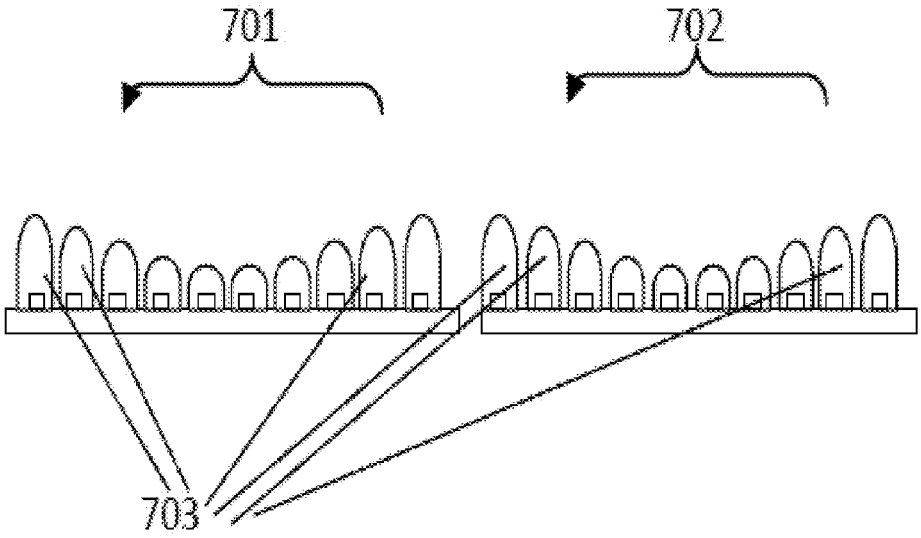
FIG. 7 is a schematic diagram illustrating a mixed LED array embodiment with multiple raised lenses having continuously varied heights.

The height of these multiple end lenses may be varied, for example graduated in heights 605, 606 as shown by FIG. 6. The mount of the variation and number of the lens may vary according to lens shape and working distance between the LEDs and the target. The height of the multiple end lenses may also vary continuously, for example graduated in heights 703 as shown by FIG. 7. The amount of the variation in graduated lens heights and number of lenses may vary according to lens shape and working distance between the LEDs and the target.

Figure 8:
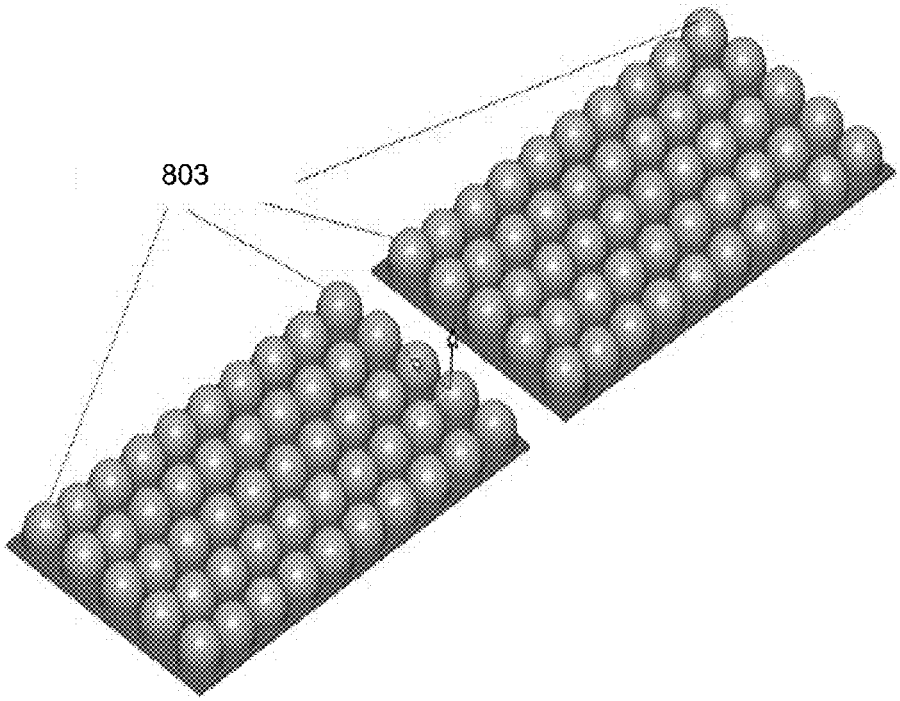
FIG. 8 is a diagram showing an exemplary embodiment of a mixed lens LED array with multiple rows.
Figure 9:
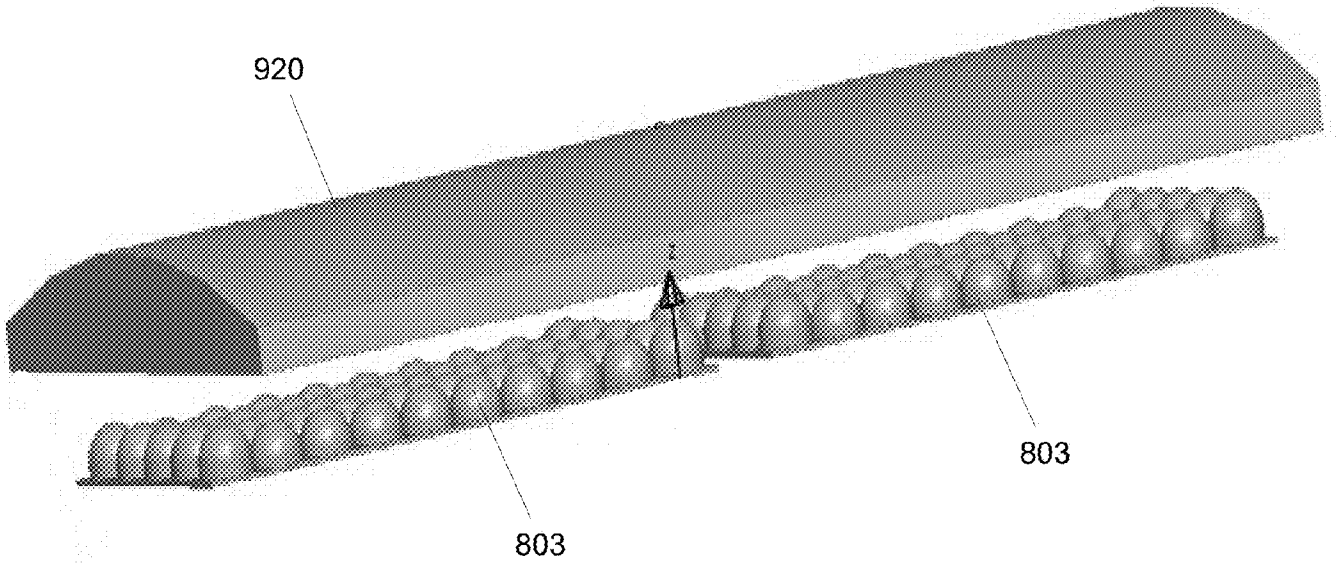
FIG. 9 is a diagram of the mixed lens LED array of FIG. 8 with secondary optics providing high irradiance for a target.

As mentioned above, a mixed lens LED array may be configured with one row or multiple rows. FIG. 8 shows multiple row LED arrays with a mixed lens array 803. The mixed lens array 803 may have second optics to have high irradiance at the target. FIG. 9 shows the mixed lens LED array with a lens 920 for secondary optics.

Figure 10A:
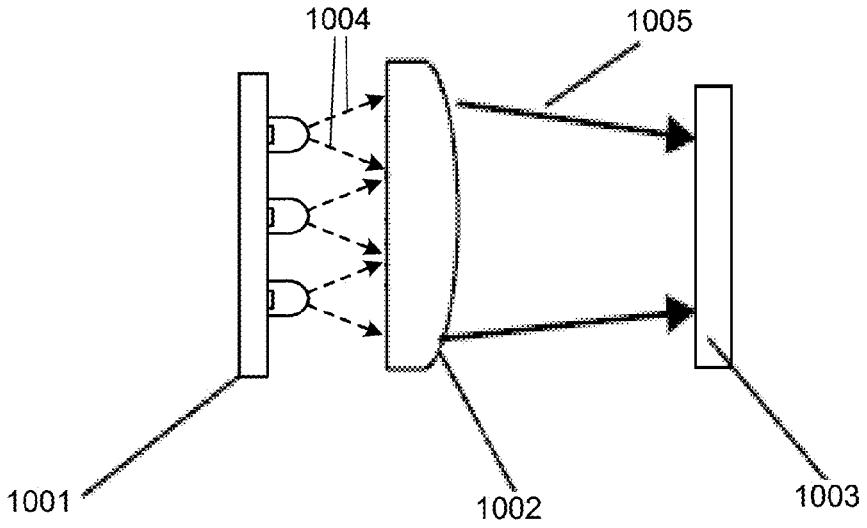
FIG. 10A is a schematic diagram showing an embodiment of an LED array where secondary optics include a lens.
Figure 10B:
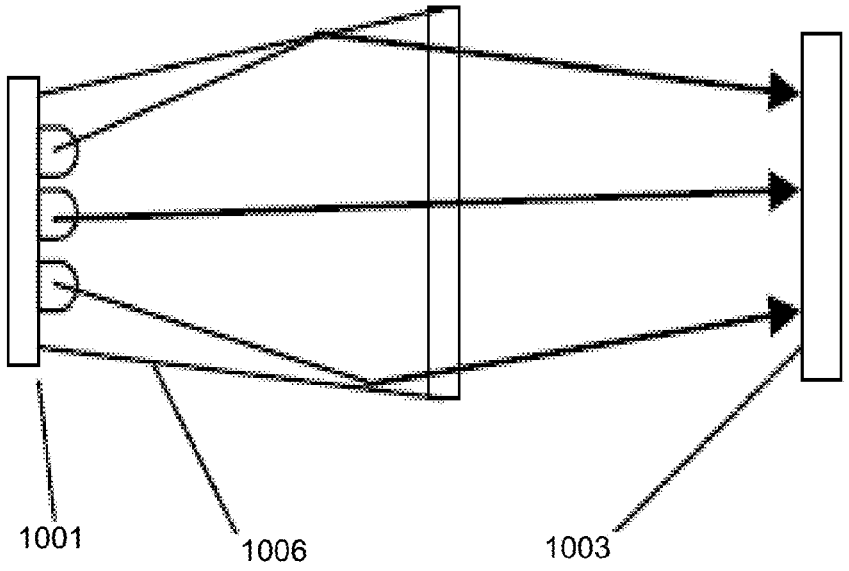
FIG. 10B is a schematic diagram showing an embodiment of an LED array where secondary optics include a reflector.

As shown by FIG. 10A, secondary optics may be a lens 1002 to focus the light beams 1004 from a mixed LED lens array 1001 to the substrate 1003 with beam 1005. In this way, higher irradiance of beam 1005 is achieved. As shown by FIG. 10B, secondary optics also may be a reflector 1006. The reflector 1006 may have different shapes, for example, parabolic for parallel light, elliptical for focus, rectangular for beam shaping, funnel for an expanding beam, or tape for a smaller beam. In addition, secondary optics may include one or more reflectors, which may be combined with one or more lenses.

The embodiments discussed above generally improve the optical uniformity of the emitted light from a large area LED array system, such as UV LED sources commonly used in the inkjet industry having lines or arrays of a large number of LEDs packed closely to each other so that jetted ink layers receive continuous irradiation.

Figure 11:
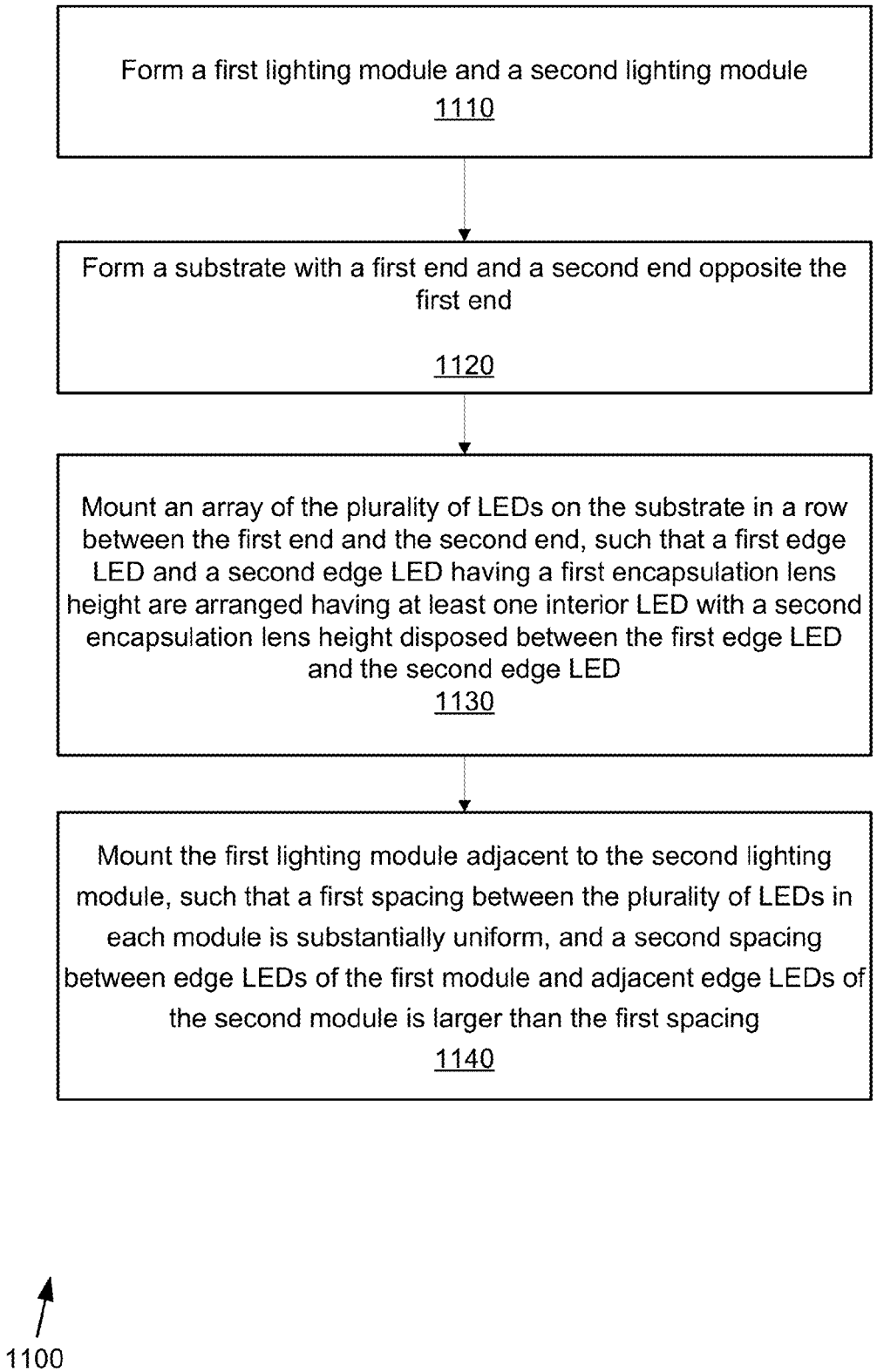
FIG. 11 is a flowchart of an exemplary method for forming a light source according to the present invention.

FIG. 11 is a flowchart of an exemplary method for forming a light source according to the present invention. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

A light source may include a plurality of solid state light emitting devices, each LED having an LED die and an encapsulating lens having an encapsulating lens height. As shown by block 1110, a first lighting module and a second lighting module are formed. As shown by blocks 1120, 1130, each module is formed with a substrate having a first end and a second end opposite the first end, and mounting an array of the plurality of LEDs on the substrate in a row between the first end and the second end. The plurality of LEDs include a first edge LED and a second edge LED having a first encapsulation lens height relative to the substrate. The first edge LED is disposed adjacent to the first end, the second edge LED disposed adjacent to the second end, and at least one interior LED has a second encapsulation lens height less than the first encapsulation lens height disposed between the first edge LED and the second edge LED. The first lighting module is mounted adjacent to the second lighting module, as shown by block 1140, such that a first spacing between the plurality of LEDs in each module is substantially uniform, and a second spacing between edge LEDs of the first module and adjacent edge LEDs of the second module is larger than the first spacing.

While the above embodiments have generally described applications of an array of LEDs having edge encapsulation heights at the edges higher than interior LED encapsulation heights where two or more arrays abut, there are also applications for a single such LED array. As shown in FIG. 1E, the sharpness of the edge illumination 120 is improved if the interior lens encapsulations are the same height, but with raised edge lens encapsulations 119, as compared with an array (shown in FIG. 1D) where the edge illumination pattern 121 over lens encapsulations having uniform height rolls off more gradually. Therefore, the abovementioned embodiments are advantageous in applications for a single LED array where the illumination level is substantially uniform above the array up to and/or beyond the array edges.

Figure 12:
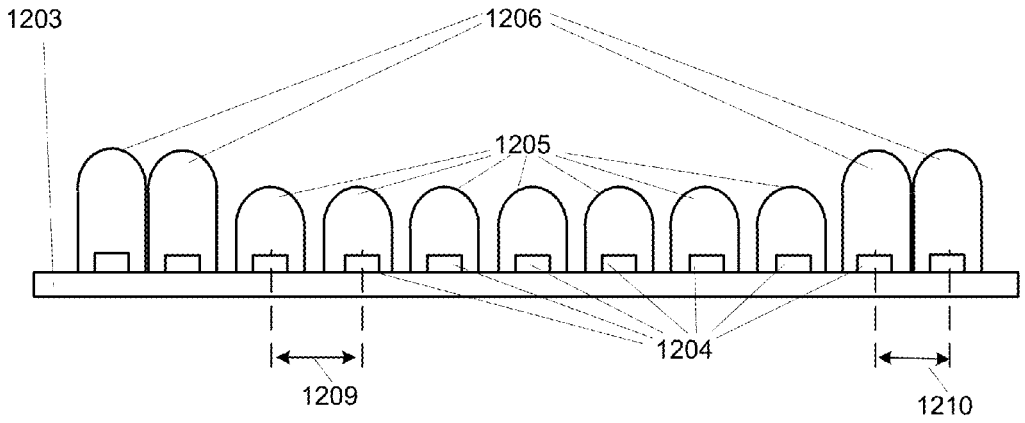
FIG. 12 is a schematic diagram illustrating a third exemplary embodiment of a mixed LED array with raised edge LED encapsulation lenses having a narrower spacing than the interior LEDs.

As shown in FIG. 12, under a third embodiment, for an LED array mounted on a PCB 1203, the spacing 1210 of LED dies 1204 having higher encapsulations 1206 at the edge of the array may be smaller than the spacing 1209 of the LED dies 1204 having lower encapsulations 1205 at the interior of the array, thereby further increasing the illumination levels above the edges of the array, and/or providing a more uniform level of illumination above the array out to and/or beyond the edges of the array. While FIG. 12 shows two edge LED dies 1204 having higher encapsulations 1206 at both edges of the LED array, in alternative embodiments there may be three or more edge LED dies 1204 having higher encapsulations 1206 at both edges of the LED array. Further, there may be alternative embodiments where a first number of edge LEDs 1204 having higher encapsulations 1206 on a first edge is not equal to a second number edge LED dies 1204 having higher encapsulations 1206 on a second edge of the LED array. For example, a first edge may have a single row of higher encapsulations 1206, while a second edge may have a double row of higher encapsulations 1206.

In summary, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light source comprising:

a first lighting module and a second lighting module, each lighting module further comprising:

a substrate comprising a first end and a second end opposite the first end;

a plurality of solid state light emitting diodes (LEDs), each LED further comprising an LED die and an encapsulating lens comprising a lower cylindrical section and an upper hemispherical dome section, the encapsulating lens having an encapsulating lens height defined by a distance from where the cylindrical section meets the LED die surface to a peak of the hemispherical dome section of the encapsulation lens; and an array comprising the plurality of LEDs mounted on the substrate in a row between the first end and the second end, the plurality of LEDs further comprising a first edge LED and a second edge LED having a first encapsulating lens height relative to the substrate, the first edge LED disposed adjacent to the first end, the second edge LED disposed adjacent to the second end, and at least one interior LED having a second encapsulating lens height less than the first encapsulating lens height disposed between the first edge LED and the second edge LED, wherein a first spacing between the plurality of LEDs is substantially uniform, and the first edge LED and the second edge LED are configured to have a first output beam directivity that is different from a second output beam directivity of the at least one interior LED, a diameter of the cylindrical section of the encapsulating lenses is uniform; and a mounting surface comprising the first lighting module mounted adjacent to the second lighting module, wherein a second spacing between edge LEDs of the first module and adjacent edge LEDs of the second module is larger than the first spacing, the first output beam directivity is configured so a first illumination intensity above an abutting region between the first lighting module and the second lighting module is substantially the same as a second illumination intensity over the first lighting module or the second lighting module.

2. The light source of claim 1, wherein the first and/or second array further comprises a third edge LED having the first encapsulation lens height relative to the substrate disposed adjacent to the second edge LED.

3. The light source of claim 2, wherein the first and/or second array further comprises at least two interior LEDs, and a second spacing between the third edge LED and the second edge LED, wherein the second spacing is less than the substantially uniform spacing between the at least two interior LEDs.

4. The light source of claim 1, wherein the first and/or second array further comprises an intermediate LED having a third encapsulation lens height relative to the substrate disposed adjacent to one edge LED and one interior LED, wherein the third encapsulation lens height is greater than the second encapsulation lens height and less than the first encapsulation lens height.

5. The light source of claim 1, wherein the first and/or second array further comprises two or more intermediate LEDs having graduated encapsulation lens heights relative to the substrate disposed adjacent to one edge LED and one interior LED, wherein the graduated encapsulation lens heights are greater than the second encapsulation lens height and less than the first encapsulation lens height.

6. The light source of claim 1, wherein the first and/or second array further comprises a plurality of rows of LEDs mounted on the substrate.

7. The light source of claim 1, wherein for the first and or second lighting module a first row of LEDs is configured substantially similarly to a second row of LEDs adjacent to the first row of LEDs.

* * * * *